US007311389B1

(12) United States Patent
Pidgeon

(10) Patent No.: US 7,311,389 B1
(45) Date of Patent: Dec. 25, 2007

(54) INK MAINTENANCE SYSTEM FOR INK JET CARTRIDGES

(76) Inventor: Tarry Pidgeon, 11538 W. Calla Rd., Salem, OH (US) 44460

( * ) Notice: Subject to any disclaimer, the term of this patent is extended or adjusted under 35 U.S.C. 154(b) by 273 days.

(21) Appl. No.: 11/053,646

(22) Filed: Feb. 9, 2005

(51) Int. Cl.
*B41J 2/18* (2006.01)
*B41J 2/17* (2006.01)

(52) U.S. Cl. ..... 347/89; 347/84

(58) Field of Classification Search ..... 347/85, 347/86, 87, 89; 141/2, 18
See application file for complete search history.

(56) References Cited

U.S. PATENT DOCUMENTS 3,452,361 A 6/1969 Williams, Jr.
3,708,798 A 1/1973 Hildenbrand et al.
3,761,953 A 9/1973 Helgeson et al.
3,961,337 A 6/1976 Jung et al.
3,967,286 A 6/1976 Anderson et al.
4,074,284 A 2/1978 Dexter et al.
4,178,595 A 12/1979 Jinnai et al.
4,187,511 A 2/1980 Robinson
4,318,114 A 3/1982 Huliba
4,325,072 A 4/1982 Rosel
4,342,041 A 7/1982 Kasugayama
4,342,042 A 7/1982 Cruz-Uribe et al.
4,346,388 A 8/1982 Wiley
4,356,499 A 10/1982 Kodama
4,359,744 A 11/1982 Salmre
4,380,770 A 4/1983 Maruyama
4,383,263 A 5/1983 Ozawa et al.
4,394,669 A 7/1983 Ozawa et al.
4,399,446 A 8/1983 McCann et al.
4,403,233 A 9/1983 Terasawa et al.
4,429,320 A 1/1984 Hattori et al.
4,432,005 A 2/1984 Duffield et al.
4,433,341 A 2/1984 Thomas
4,437,104 A 3/1984 Hudson
4,462,037 A 7/1984 Bangs et al.
4,475,116 A 10/1984 Sicking et al.
4,500,895 A 2/1985 Buck et al.
4,527,175 A 7/1985 Kojima et al.
4,558,326 A 12/1985 Kimura et al.
4,575,738 A 3/1986 Sheufelt et al.
4,593,294 A 6/1986 Parisi
4,607,261 A 8/1986 McCann et al.
4,610,202 A 9/1986 Ebinuma et al.

(Continued)

FOREIGN PATENT DOCUMENTS

DE 2336 485 2/1975

(Continued)

*Primary Examiner*—Anh T. N. Vo
(74) *Attorney, Agent, or Firm*—Harpman & Harpman

(57) ABSTRACT

An ink supply system is provided for commercial ink jet printing equipment having multiple disposable ink jet printing cartridges. The ink supply system of the invention is adapted to maintain ink supply to multiple ink jet cartridges by circulating a supply of ink from an independent storage reservoirs through the ink jet cartridge and back to the reservoir via a circulation pump in a closed loop system. Flexible supply and return tubing interlinks the storage reservoir with the modified ink jet printing cartridge and a circulation pump for return back to the ink jet storage reservoir. The system maintains ink jet cartridge required internal negative pressure in a balanced circulation supply replenishment system replacing ink as it is used by the print cartridge.

12 Claims, 4 Drawing Sheets

U.S. PATENT DOCUMENTS

| | | | | |
|---|---|---|---|---|
| 4,614,948 | A | | 9/1986 | Katerberg et al. |
| 4,623,905 | A | | 11/1986 | Ichiashi et al. |
| 4,631,556 | A | | 12/1986 | Watanabe et al. |
| 4,636,814 | A | | 1/1987 | Terasawa |
| 4,639,738 | A | | 1/1987 | Young et al. |
| 4,658,272 | A | | 4/1987 | Toganch et al. |
| 4,677,448 | A | | 6/1987 | Mizusawa et al. |
| 4,679,059 | A | | 7/1987 | Dagna |
| 4,680,696 | A | | 7/1987 | Ebinuma et al. |
| 4,684,962 | A | | 8/1987 | Hirosawa et al. |
| 4,714,937 | A | | 12/1987 | Kaplinsky |
| 4,734,719 | A | | 3/1988 | Sukuki |
| 4,737,801 | A | | 4/1988 | Ichihashi et al. |
| 4,757,331 | A | | 7/1988 | Mizusawa |
| 4,775,871 | A | | 10/1988 | Abe et al. |
| 4,791,438 | A | | 12/1988 | Hanson et al. |
| 4,794,409 | A | | 12/1988 | Cowger et al. |
| 4,823,146 | A | | 4/1989 | Cooke et al. |
| 4,831,389 | A | | 5/1989 | Chan |
| 4,833,491 | A | | 5/1989 | Rezanka |
| 4,853,717 | A | | 8/1989 | Harmon et al. |
| 4,885,595 | A | | 12/1989 | Kaplinsky et al. |
| 4,921,811 | A | | 5/1990 | Watanabe et al. |
| 4,926,196 | A | | 5/1990 | Mizoguchi et al. |
| 4,929,963 | A | | 5/1990 | Balazar |
| 4,931,811 | A | | 6/1990 | Cowger et al. |
| 4,931,812 | A | | 6/1990 | Dunn et al. |
| 4,959,667 | A | | 9/1990 | Kaplinsky |
| 4,967,207 | A | | 10/1990 | Ruder |
| 4,968,998 | A | | 11/1990 | Allen |
| 4,970,533 | A | | 11/1990 | Satio et al. |
| 4,973,993 | A | | 11/1990 | Allen |
| 4,977,413 | A | | 12/1990 | Yamanaka et al. |
| 4,992,802 | A | | 2/1991 | Dion et al. |
| 4,999,652 | A | | 3/1991 | Chan |
| 5,021,809 | A | | 6/1991 | Abe et al. |
| 5,040,001 | A | | 8/1991 | Dunn et al. |
| 5,051,759 | A | | 9/1991 | Karita et al. |
| 5,079,570 | A | | 1/1992 | Mohr et al. |
| 5,101,219 | A | | 3/1992 | Gerber et al. |
| 5,121,132 | A | | 6/1992 | Pan et al. |
| 5,126,767 | A | | 6/1992 | Asai |
| 5,136,305 | A | | 8/1992 | Ims |
| 5,182,579 | A | | 1/1993 | Harute et al. |
| 5,187,498 | A | | 2/1993 | Burger |
| 5,189,438 | A | | 2/1993 | Hine et al. |
| 5,245,360 | A | | 9/1993 | Ebinuma et al. |
| 5,245,365 | A | | 9/1993 | Woodard et al. |
| 5,280,300 | A | | 1/1994 | Fong et al. |
| 5,289,211 | A | | 2/1994 | Morandotti et al. |
| 5,309,180 | A | | 5/1994 | Uchida |
| 5,339,845 | A | * | 8/1994 | Huddas ..... 134/169 A |
| 5,367,328 | A | | 11/1994 | Erickson |
| 5,369,429 | A | | 11/1994 | Erickson |
| 5,561,448 | A | * | 10/1996 | Kaneko et al. ..... 347/29 |
| 5,818,485 | A | | 10/1998 | Rezanka |
| 5,877,793 | A | | 3/1999 | Erickson |
| 5,917,515 | A | | 6/1999 | Nonoyama et al. |
| 6,007,190 | A | | 12/1999 | Murray et al. |
| 6,164,766 | A | | 12/2000 | Erickson |
| 6,565,197 | B1 | | 5/2003 | Murray et al. |
| 6,715,863 | B2 | * | 4/2004 | Shimizu ..... 347/85 |
| 6,742,882 | B2 | * | 6/2004 | Nakamura ..... 347/89 |
| 7,128,406 | B2 | * | 10/2006 | Dixon et al. ..... 347/85 |
| 2004/0090501 | A1 | | 5/2004 | Yoshida et al. |

FOREIGN PATENT DOCUMENTS

| | | | |
|---|---|---|---|
| DE | 3034264 | C2 | 9/1980 |
| DE | 9301339 | | 6/1993 |
| DE | 09310026.4 | | 10/1993 |
| JP | 63-147651 | | 6/1980 |
| JP | 55139268 | | 10/1980 |
| JP | 55-146768 | | 11/1980 |
| JP | 59-194854 | | 11/1984 |
| JP | 60-179258 | | 9/1985 |
| JP | 63-064751 | | 3/1988 |
| JP | 3-272858 | | 12/1991 |
| JP | 4 025465 | | 1/1992 |
| JP | 5162326 | | 6/1993 |
| JP | 61-22953 | | 5/1994 |
| WO | PCT/US88/01044 | | 3/1988 |

* cited by examiner

INK MAINTENANCE SYSTEM FOR INK JET CARTRIDGES

BACKGROUND OF THE INVENTION

1. Technical Field

This device relates to commercial ink jet printers and their related disposable ink jet printing cartridges. More specifically to the automated ink cartridge refill systems for the disposable print cartridges that refill the print cartridge maintaining the hydro-dynamic properties of the cartridge required for proper printing performance.

2. Description of Prior Art

Ink jet printing cartridges and printers are well known wherein once the ink supply within the cartridge is depleted, print quality is affected and the cartridge typically fails and must be replaced. Heretofore, the print cartridges are simply replaced, as noted, being of a disposable design. However, ink jet printing cartridges print heads can still function if re-supplied with ink thus increasing the productive capacity and longevity. Prior art disposable ink jet printing cartridges guarantee that high performance and quality printing is maintained by continually replacing the cartridge at predetermined intervals based on ink usage by removing and discarding the cartridge.

Prior art ink jet printing cartridge refill systems have been developed to refill the cartridges either independently after removal or during use. Such systems typically have a supply of ink interconnected to the ink jet printing cartridge so that the printing cartridge can be refilled and used; see for example U.S. Pat. Nos. 5,917,515, 6,007,190 and 6,164,766.

In U.S. Pat. No. 5,917,515, an ink jet printing cartridge having a back-up ink jet nozzle regulation device which utilizes a bellows pump that cyclically clears the nozzle of performance diminishing obstructions which accumulate during use.

U.S. Pat. No. 6,007,190 is directed to an ink supply system for an ink printer having large volume ink containers. An ink jet printer has a large ink reservoir mounted in the printer interconnected to a multiple remote ink jet printing heads each having small ink capacity reservoirs. Ink is supplied to the printing heads via supply tubing interconnected thereto. An advantage is claimed in that by storing all of the ink away from the print head reduced print head weight is achieved thus better functioning of the printer which requires back and forth oscillation of the carriage which carries the multiple print cartridges.

U.S. Pat. No. 6,164,766 claims an automated ink refill system for disposable ink jet cartridges. An external ink reservoir is interconnected to a remote ink jet cartridge by a flexible supply tube. Once the ink supply within the ink jet cartridge reaches a predetermined level, the cartridge is refilled from the reservoir in an ongoing operation.

U.S. Pat. No. 6,565,197 discloses an improvement to the above referred U.S. Pat. No. 6,007,190 introducing a portion of the ink jet cartridge as being transparent to allow visual monitoring of the ink level therewithin.

U.S. Pat. No. 5,818,485 Rezanka directed towards a thermal ink jet printing system with continuous ink circulation through a print head.

U.S. Patent Publication 2004/0090501 A1 is directed to a complex multiple ink supply tank system for recharging an ink jet printing head. The system addresses the problems associated with such multiple tank systems and the utilization defined thereby.

SUMMARY OF THE INVENTION

An ink supply system to maintain a constant ink level within an ink jet printing cartridge. A continuous ink supply is circulated from a remote ink reservoir to and from the ink jet printing cartridge using a circulation pump in a closed loop system. Ink level within the ink jet cartridge is maintained by replacing ink used for printing while maintaining the ink level within the cartridge and the critical negative pressure hydrodynamic condition in a balanced system of supplemental ink circulating supply replacement.

DETAILED DESCRIPTION OF THE INVENTION

Figure 1:
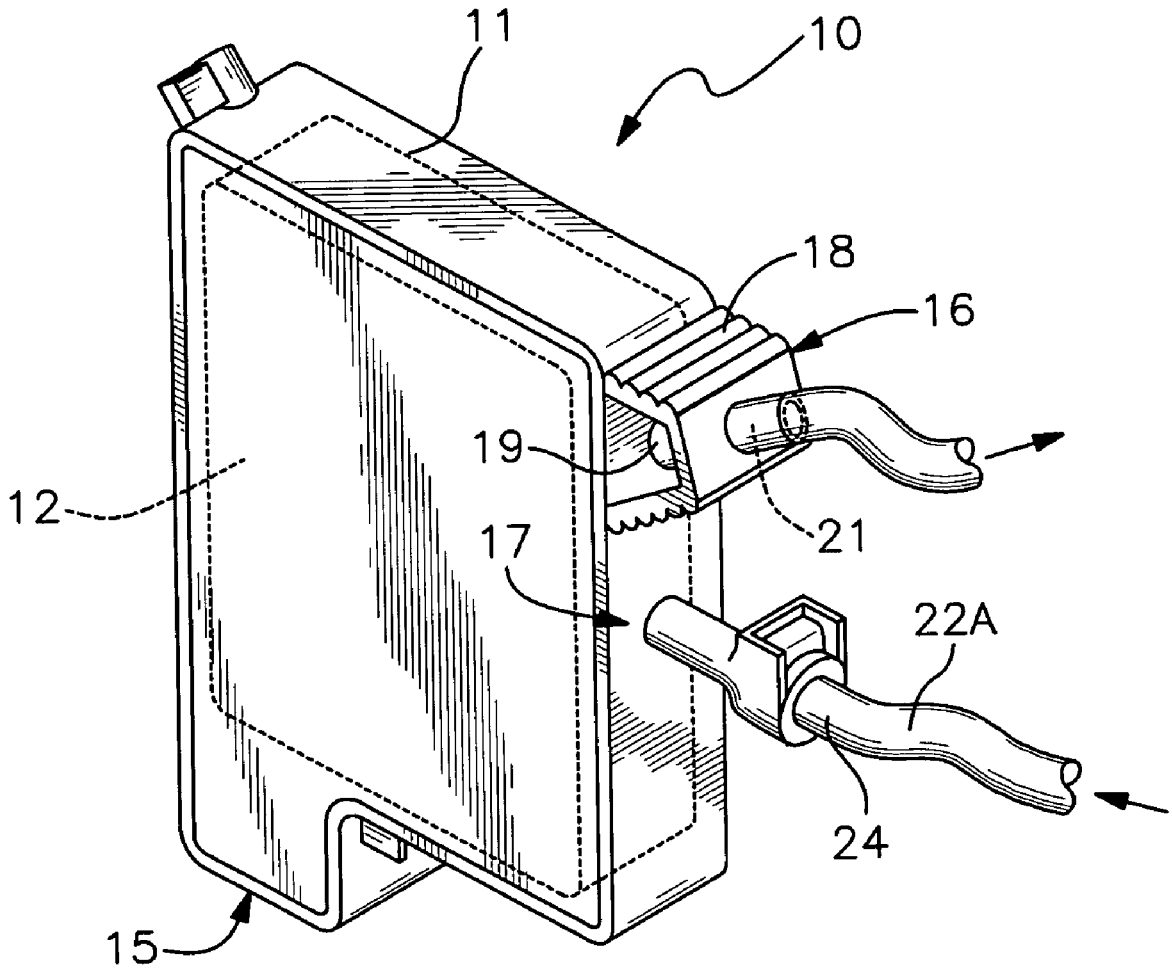
FIG. 1 is a perspective view of the modified ink jet printing cartridge used within the system of the invention.
Figure 2:
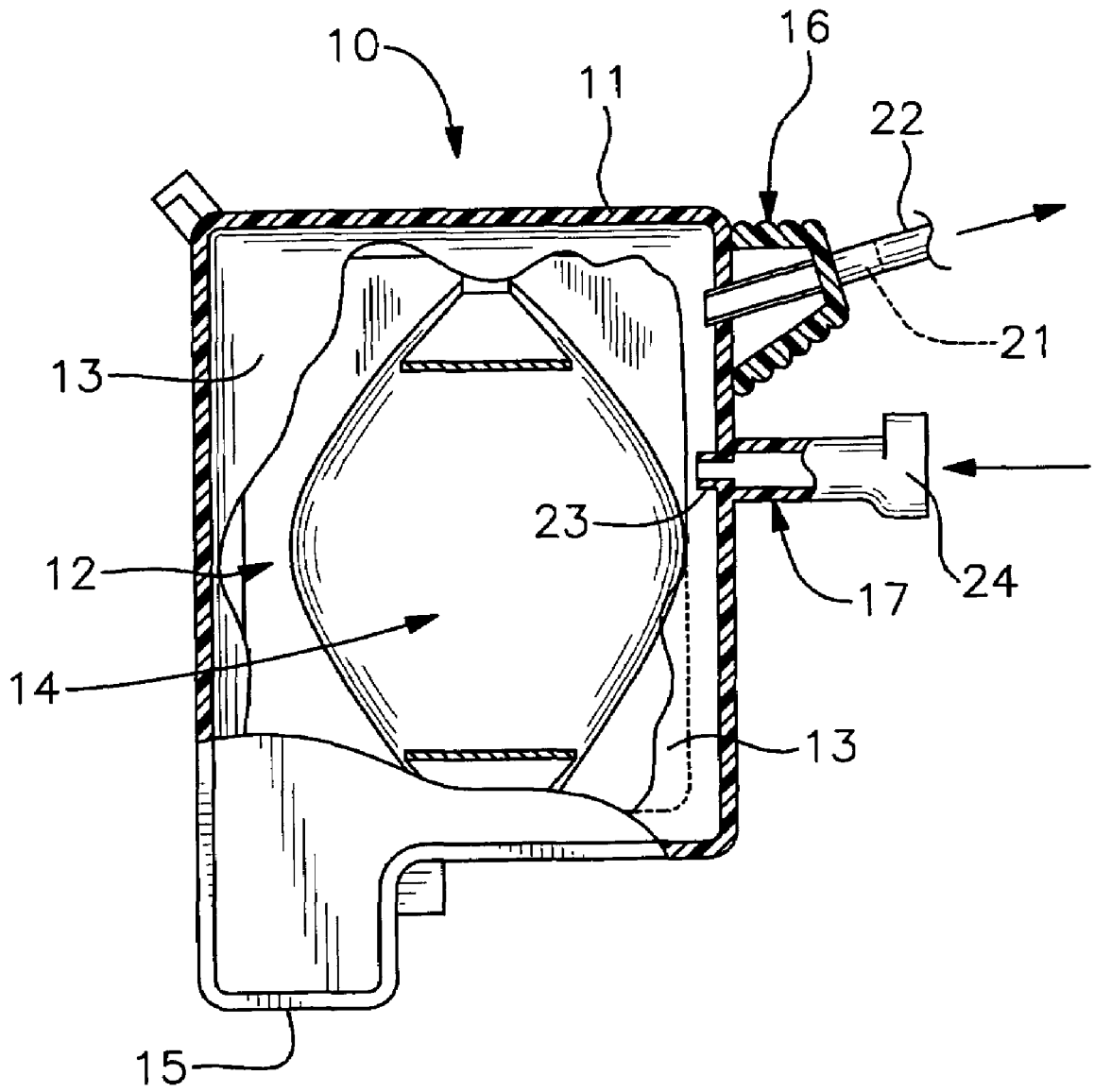
FIG. 2 is a partial sectional view of the modified ink jet printing cartridge.

Referring to FIGS. 1 and 2 of the drawings, a modified ink jet print cartridge 10 can be seen in which a standard disposable ink jet cartridge such as manufactured by Hewlett-Packard Corporation which are widely used throughout the commercial printing industry is of a disposable nature having a self-contained print head which is supplied with ink from an internal reservoir.

The modified ink jet printing cartridge 10 used in the ink supply system of the invention has a main body member 11 with an ink storage reservoir 12 therewithin. The ink storage reservoir 12 is typical to such non-modified cartridges (not shown) in which an ink storage compartment 12 has a flexible wall inner liner 13 with an internal negative pressure spring plate assembly 14 positioned therewithin. The spring plate assembly 14 is well known by those skilled in the art and is used to provide a self-adjusting pressure condition that will maintain the optimum negative pressure in a hydro-dynamic balance system within the ink reservoir as the static amount of ink is used by a print head 15 in communication therewith.

The pressure balance is critical to acceptable use requirements and additionally if the print head 15 runs out of ink, it will fail permanently which will lead to replacement of the entire cartridge.

The ink supply system of the invention modifies the standard ink jet cartridge (not shown) by adding two ink access portals 16 and 17 as seen in the ink jet printing cartridge 10. The first access portal 16 is formed within a removal engagement fitting extension 18 found on this type of print cartridge example used for illustration. The access portal 16 has a tap fitting 19 extending through the wall of the main body member 11 maintaining communication with the interior of the ink storage reservoir 12 within. The tap fitting 19 correspondingly has an attachment nozzle end 21, shown in dotted lines, for engagement of a flexible return conduit 22 thereover as will be described in greater detail hereinafter.

The remaining access portal 17 has an inlet fitting 23 with an integral quick release fitting 24 and is in spaced vertical aligned relation to the tap fitting 19 as best seen in FIG. 2 of the drawings. A flexible supply conduit and fitting 22A is appropriately secured to the quick release fitting 24 and extends from the ink jet cartridge 10 to a large remote source of printing ink I which in this example is an enclosed ink reservoir container 25.

The flexible conduit 22 extends from the nozzle end 21 to a circulation pump 26. The pump 26 is of a roller action type well known within the art that utilize a plurality of independent rollers mounted on a rotating carriage, not shown, that sequentially engages and progressively rolls thus squeezes longitudinally along a length at 23 of the flexible conduit 22 which passes through the pump 26 so as to displace the ink therealong. Such roller action type pumps are manufactured, for example, by Master Flex Company, Model L/S16 having an adjustable flow rate based on a 0.8 mL per revolution with a 0.8 to 80 operational RPM range.

The flexible return conduit 22 as noted, passes through the pump 26 and back to the ink reservoir container 25 completing a closed loop circulation circuit illustrated by directional arrows in FIG. 2 of the drawings.

Figure 3:
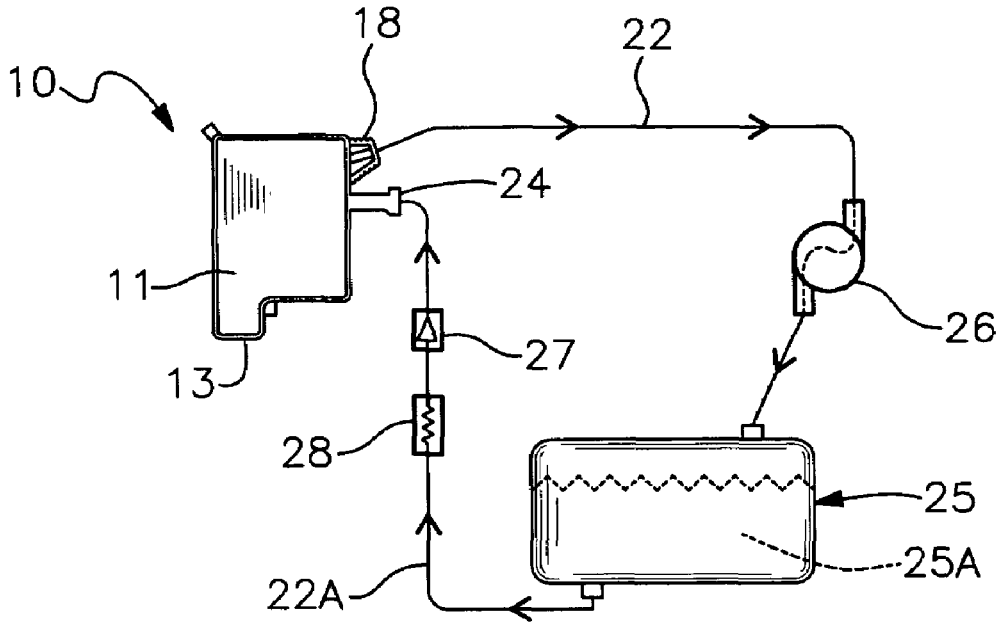
FIG. 3 is a graphic systematic representation of the integral ink supply and recirculating system of the invention.

A one-way check valve 27 and filter 28 are positioned along the supply conduit 22A wherein ink from the reservoir container 25 is drawn therethrough into the ink jet printing head 10 via the inlet portal 17 as indicated by directional flow arrows in FIGS. 1-3 of the drawings.

It will be evident therefore that in operation the ink supply system of the invention provides for a continuous replenishment of printing ink to the ink jet printing cartridge 10 by creating a balanced circulation of ink from the ink reservoir container 25 through the ink jet cartridge 10 and back to the reservoir container 25 via the recirculation pump 26 keeping the ink reservoir in the ink jet printing cartridge 10 filled at all times.

By regulating the speed of the pump 26 and adjusting the lengths of the respective flexible return and supply conduits 22 and 22A which are of plastic tubing and the positioning of the ink reservoir 24, a supply circulation equilibrium is achieved within the modified ink jet printing cartridge 10. As such, the ink storage reservoir 12 within, the ink jet cartridge 10, is always maintained in a full state wherein as the ink circulates therethrough, only the actual amount of ink used by the print head 15 is replaced. It is this unique balance ink supply system of the invention that maintains the ink jet printing cartridge 10 in a useful state and prevents premature print head 15 failure by loss of ink which is common within the industry given the high speed of production and the quantities of ink used.

It will be evident from the above referred to description that preferably the ink in the ink reservoir supply container 25 be maintained at a predetermined amount to maintain balanced flow characteristics to the hereinbefore described system as illustrated graphically in FIG. 3 of the drawings.

Figure 4:
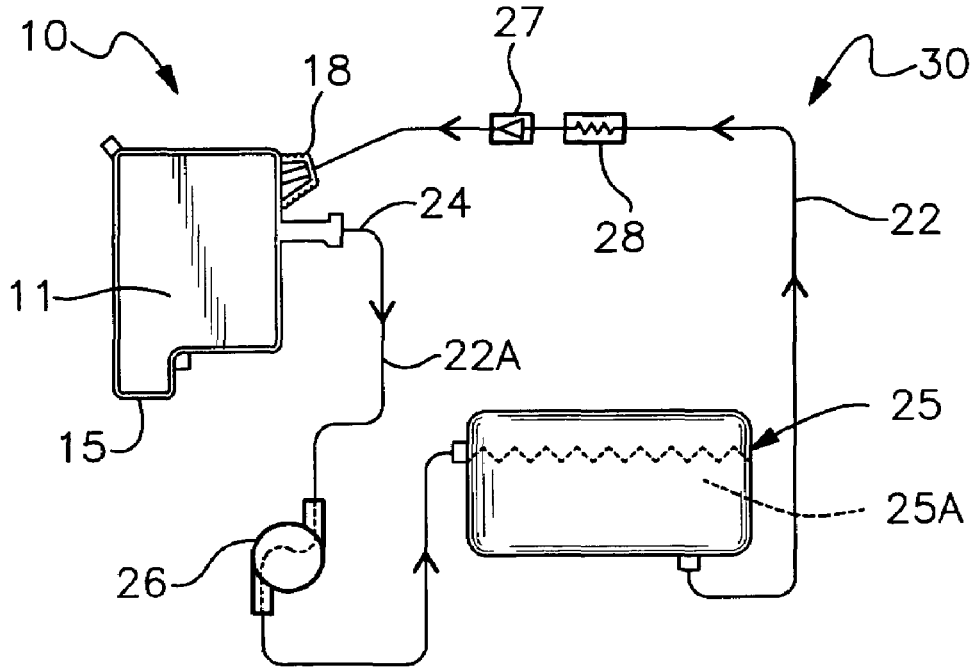
FIG. 4 is a graphic systematic representation of an alternate flow path integrated ink supply and recirculation system.

Referring now to FIG. 4 of the drawings, an alternate supply system 30 can be seen wherein the directional circulation of the ink is modified. The ink is drawn out of the modified ink jet printing cartridge 10 via the access portal 17 by the recirculation pump 26 in communication therewith and then to the ink storage reservoir 25. Correspondingly, the ink is drawn from the storage reservoir 25 through supply conduit 22 via the filter 28 and one-way valve 27 and into the modified ink jet printer cartridge 10 through the access portal 15 and its hereinbefore described tap fitting 19 and modified nozzle end 21. This alternate circulation system 30 is achieved by switching the position of the pump 26 and the one-way valve 26 and 27 on the supply and return conduits 22 and 28 respectively. It will be evident from the above description that by maintaining the ink circulation through the modified ink jet printing cartridge 10 that the natural position of the negative spring leaf assembly 14 is maintained and thus the required hydro-dynamic pressure within the cartridge in a negative state to prevent unintended loss of ink through the print head 15 when not in use. Failure to maintain the negative pressure balance will result in either the collapse of the spring assembly 14 cutting off the supply of ink to the printing head 15 or alternately over-pressurization of the ink jet printing cartridge 10 in which the ink will actually drip out of the print head 15.

Figure 5:
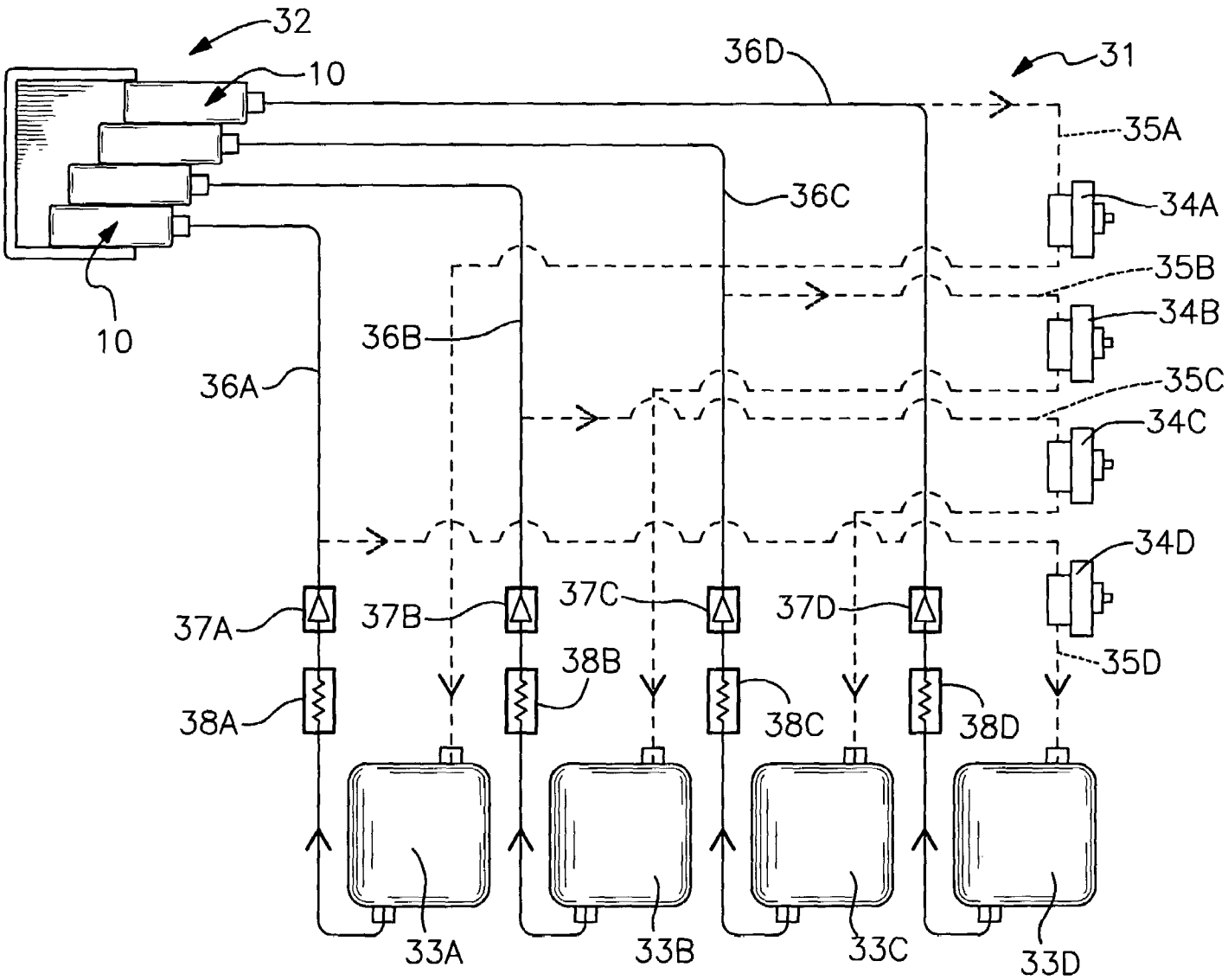
FIG. 5 is a graphic systematic flow representation of a multiple ink jet printing cartridge with corresponding ink supplies and recirculating systems within a single printing configuration.

Referring now to FIG. 5 of the drawings, a multiple ink jet printing cartridge ink supply system can be seen at 31 in which a multiple ink jet printing cartridge assembly 32 having independent modified ink jet cartridges 10 which are interconnected to their own respective remote repositioned ink supply reservoirs 33A, 33B, 33C and 33D. The multiple ink jet printing cartridges 10 used in this example have multiple interconnected independent circulation pumps 34A-D and associated returned lines 35A-D shown in broken lines for illustration purposes. Multiple circulation ink supply lines 36A-D have as required their own respective one-way inline valves 37A-D and inline filters 38A-D as required in the present form of the invention.

By utilizing multiple circulation pumps 34A-D an independent ink supply reservoirs 35A-D the operator is afforded a variety of maintenance options including multiple color ink setups and quick interchange of cartridges, if required for different setups.

It will thus be seen that a new and novel ink jet printing cartridge ink supply system has been illustrated and described and that various changes and modifications may be made thereto without departing from the spirit of the invention.

Therefore I claim:

1. An ink supply system for commercial ink jet printing cartridge printer comprises:

an ink jet printing cartridge having a housing, a flexible collapsible ink storage chamber within said housing, means for maintaining said collapsible ink storage chamber under sub-atmospheric pressure a printing head within said housing in communication with said ink storage chamber, supply and return fluid passageways interconnecting said collapsible ink storage chamber with a large volume ink container a circulation pump in communication with said fluid passageways for circulating ink from within said large volume ink container through said flexible collapsible ink storage chamber and back to said large volume ink container while maintaining said sub-atmospheric pressure therein, and a selective directional flow means between said large volume ink container and said flexible collapsible ink storage chamber.

2. The ink supply system for commercial ink jet printing as set forth in claim 1 wherein said housing having access portals with tubular insert fittings in communication with said fluid passageways defining respective supply and return conduits.

3. The ink supply system for commercial ink jet printing set forth in claim 2 wherein said supply and return access portals are in spaced relation from each other.

4. The ink supply system for commercial ink jet printing set forth in claim 1 wherein said selective directional flow means between said large volume ink container and said flexible collapsible ink storage chamber comprises a one-way valve.

5. The ink supply system for commercial ink jet printing set forth in claim 1 wherein said fluid passageways are conduits of a flexible synthetic resin tubing.

6. The ink supply system for commercial ink jet printing set forth in claim 1 wherein said large volume ink container is remotely located from said ink jet printing cartridge.

7. The ink supply system for commercial ink jet printing set forth in claim 1 wherein said means for maintaining said flexible collapsible ink storage chamber under sub-atmospheric pressure comprises, circulating ink from said large volume ink container through said flexible collapsible ink storage chamber and back to said large volume ink container at a rate beyond the known ink usage rate of said printing head of said ink jet printing cartridge.

8. The ink supply system for commercial ink jet printing set forth in claim 1 wherein said ink in said large volume ink container is maintained at a predetermined level.

9. The ink supply system for commercial ink jet printing set forth in claim 1 wherein said circulation pump is positioned in selective communication with said respective fluid passageways.

10. An ink supply system for multi-ink jet printing cartridge printers comprises:

a plurality of ink jet printing cartridges in communication with multiple respective large volume ink containers, each of said ink jet printing cartridges comprises:

a housing, a flexible collapsible ink storage chamber within said housing, a print head in communication with said flexible collapsible ink storage chamber, inlet and outlet openings in said housing in communication with said flexible collapsible ink storage chamber, flexible fluid passageway supply and return lines extending from said respective inlet and outlet openings in said ink jet printing cartridge to said respective large volume ink containers, circulation pumps in selective communication with said respective fluid passageways circulating ink continuously from said respective large volume ink containers through said flexible collapsible ink storage chamber and back to said respective large volume ink containers so as to maintain the flexible collapsible ink storage chamber under sub-atmospheric pressure, and directional circulation and filter means on said respective supply lines.

11. The ink supply system set forth in claim 10 wherein each of said filter means associated with a corresponding directional circulation means on said flexible fluid passageway supply and return lines comprising inline directional flow filter and an one-way directional flow valve.

12. The ink supply system set forth in claim 10 wherein said large volume ink containers are remotely located from said respective ink printing cartridges.

* * * * *